US006261093B1

(12) United States Patent
Matros et al.

(10) Patent No.: US 6,261,093 B1
(45) Date of Patent: Jul. 17, 2001

(54) HEAT REGENERATIVE OXIDIZER AND METHOD OF OPERATION

(75) Inventors: Yurii S. Matros, Chesterfield; Grigori A. Bunimovich, St. Louis; Christopher A. Roach, Richmond Heights, all of MO (US)

(73) Assignee: Monsanto Company, St. Louis, MO (US)

( * ) Notice: Subject to any disclaimer, the term of this patent is extended or adjusted under 35 U.S.C. 154(b) by 0 days.

(21) Appl. No.: 09/496,822

(22) Filed: Feb. 2, 2000

Related U.S. Application Data

(60) Provisional application No. 60/118,292, filed on Feb. 2, 1999.

(51) Int. Cl.[7] ..... F27D 17/00

(52) U.S. Cl. ..... 432/181; 432/39; 432/180

(58) Field of Search ..... 432/179, 180, 432/181, 182, 28, 39, 54, 165; 431/12, 66, 75, 85

(56) References Cited

U.S. PATENT DOCUMENTS

| | | | |
|---|---|---|---|
| 2,121,733 | 6/1938 | Cottrell | 183/6 |
| 3,870,474 | 3/1975 | Houston | 23/277 |
| 4,154,567 | 5/1979 | Dahmen | 431/5 |
| 4,756,688 | 7/1988 | Hammond et al. | 432/180 |
| 4,877,592 | 10/1989 | Matros et al. | 423/245.1 |
| 5,161,968 | 11/1992 | Nutcher et al. | 432/179 |
| 5,163,829 | 11/1992 | Wildenberg | 431/5 |
| 5,184,951 | 2/1993 | Nutcher et al. | 432/28 |
| 5,188,804 | 2/1993 | Pace et al. | 422/111 |
| 5,364,259 | 11/1994 | Matros et al. | 431/5 |
| 5,366,708 | 11/1994 | Matros et al. | 423/210 |
| 5,417,927 * | 5/1995 | Houston | 432/181 |
| 5,538,693 | 7/1996 | Olivier et al. | 422/111 |
| 5,658,541 | 8/1997 | Matros et al. | 423/210 |
| 5,823,770 | 10/1998 | Matros et al. | 432/181 |

* cited by examiner

*Primary Examiner*—Jiping Lu
(74) *Attorney, Agent, or Firm*—Senniger, Powers, Leavitt & Roedel

(57) ABSTRACT

The present invention relates to regenerative thermal or catalytic oxidizers and methods of operation thereof for oxidizing combustible components of feed gas mixtures. In accordance with the disclosed invention, operation of the heater used to supply supplemental heat to regenerative heat transfer oxidizers is controlled such that the input load to the heater is varied between a maximum input load and a nominal input load in response to a measured control temperature. The present invention provides improved temperature uniformity across the system for more efficient operation.

28 Claims, 2 Drawing Sheets

HEAT REGENERATIVE OXIDIZER AND METHOD OF OPERATION

This application claims the benefit of U.S. provisional application Ser. No. 60/118,292, filed Feb. 2, 1999, the disclosure of which is expressly incorporated herein by reference.

BACKGROUND OF THE INVENTION

The present invention relates generally to reaction of feed gas mixtures in regenerative heat transfer incinerators or oxidizers. More particularly, the present invention relates to apparatus and methods for oxidation of combustible components of feed gas mixtures in regenerative thermal or catalytic oxidizers. The present invention may be used to abate, through oxidation, combustible contaminants (e.g., volatile organic compounds, carbon monoxide, etc.) contained in gaseous industrial emissions.

Heat regenerative oxidizers are widely used to control air pollution from industrial sources. Regenerative oxidizers are characterized by heat sinks (i.e., beds of solid heat exchange material), which extract and store heat from the reacted feed gas mixture so that this heat may be used to increase the temperature of the incoming gas and thereby reduce external energy requirements of the system. These systems are configured in a variety of ways and include both regenerative thermal oxidizers (RTOs) and regenerative catalytic oxidizers (RCOs). Examples of heat regenerative oxidizers suitable for air pollution control service are shown and described in U.S. Pat. No. 5,823,770 (Matros, et al.), U.S. Pat. No. 5,366,708 (Matros, et al.), U.S. Pat. No. 5,364,259 (Matros, et al.), U.S. Pat. No. 5,163,829 (Wildenberg) and U.S. Pat. No. 5,161,968 (Nutcher, et al.).

The gaseous emissions treated in RCOs or RTOs often have a relatively low concentration of volatile organic compounds (VOCs) and other combustible contaminants. The adiabatic temperature rise of VOC oxidation in heat regenerative systems is often below 30° C. Under these conditions, heat regenerative systems typically require supplementary heat input in order to maintain the temperature in the combustion chamber of an RTO or catalytic zone of an RCO sufficiently high to achieve the desired degree of oxidation of contaminants in the gas to be treated. Conventionally, externally fueled burners and, to a much lesser extent, electric heating elements are employed as heaters to introduce supplemental heat energy into the system. A typical RTO installation includes one or more burners directed into the combustion chamber. Likewise, a typical dual bed RCO includes one or more burners directed into the duct through which the gas passes from one catalytic zone to the other. In addition to providing supplemental heat to the system during operation, the supplemental heat source is used to initially heat the system at startup.

After startup, the heater is commonly operated using continuous modulated control. For example, in the case of a burner, the rate at which fuel is delivered to the burner (i.e., the fuel load) is regulated by a controller which turns a valve in the fuel supply line in response to changes in one or more measured control variables, such as the temperature measured inside the combustion chamber or within the catalyst or beds of heat exchange material. Three-mode proportional-integral-derivative controllers are usually employed. The objective of conventional control schemes is to deliver enough fuel to the burner to maintain the measured temperature essentially constant at the established set temperature value. Overshooting the set temperature to any significant degree and off-set are purposely avoided by the control algorithm which may be quite complicated and include such factors as the magnitude of the difference between the measured temperature and the set temperature and the rate of change of the measured temperature. Thus, rather than simply decreasing or increasing the fuel load to the burner when the measured temperature is above or below the set temperature value, the control response varies throughout the range permitted by the valve as needed to avoid significant excursions from the set temperature. In practice, conventional control results in a moderate fuel load being delivered to the burner throughout much of the process. Likewise, conventional control of electric heaters used to provide supplemental heat energy to a regenerative heat transfer oxidizer system typically results in continuous, moderate power input to the heater.

In order for regenerative oxidizers to function efficiently, it is desirable to maintain the temperature profile across those regions of the system in which VOC oxidation primarily occurs (i.e., within and adjacent the combustion chamber in RTOs and within and adjacent the catalytic zones of RCOs) substantially uniform and at or just above the minimum necessary to achieve the desired VOC destruction efficiency. Nevertheless, many existing regenerative oxidizer systems are plagued by substantial temperature variance across these critical regions of the system. Oxidation of VOCs is compromised in the fraction of the gas flow not heated to the requisite minimum temperature, ultimately reducing the overall VOC destruction efficiency of the system. Although the input load to the supplemental heat source may be increased generally in an attempt to raise the temperature profile across the entire system and remove "cold spots", this practice results in increased fuel costs and potential overheating and decreased service life for process equipment, heat exchange material and catalyst. U.S. Pat. No. 4,877,592 (Matros, et al.) discloses a method of catalytic cleaning of exhaust gases in an RCO in which nonuniform temperature profiles in the catalyst are reduced by stirring the gas exiting a first catalytic zone before being introduced into a second catalytic zone. The gas is stirred using a fan, double-segmented grid or mixing tube. This proposed solution suffers from increased system complexity and equipment costs.

SUMMARY OF THE INVENTION

Among the objects of the present invention, therefore, are the provision of an apparatus and method of operation for use in reacting a feed gas mixture in a heat regenerative oxidizer; the provision of such an apparatus and method which may be used to oxidize combustible contaminants in a feed gas mixture comprising industrial gaseous emissions; the provision of such an apparatus and method which reduce nonuniformities in the temperature profile across the system; the provision of such an apparatus and method which provide improved destruction efficiency of combustible contaminants contained in the feed gas mixture; the provision of such an apparatus and method in which the amount of heat exchange material and/or catalyst employed may be reduced; and the provision of such an apparatus and method having reduced energy requirements.

Briefly, therefore, the present invention is directed to a method for controlling operation of a heater associated with a regenerative heat transfer oxidizer system used to oxidize a combustible component of an oxygen-containing feed gas mixture. The system comprises a vessel containing at least two heat exchange zones in fluid communication through a void chamber and the heater for introducing supplemental heat energy into the void chamber. Each of the heat exchange zones contains a gas-permeable bed comprising solid heat exchange material. The system further comprises a sensor for measuring the temperature at a position within the vessel and a heater controller for varying the input load to the heater in response to the temperature measured at the sensor. The method comprises measuring the temperature at the sensor and comparing the measured temperature to a set temperature value, $T_s$. While the temperature measured at the sensor is above $T_s$, a nominal input load is provided to the heater such that supplemental heat energy is introduced into the void chamber at a rate below that required to prevent the temperature measured at the sensor from decreasing. while the temperature measured at the sensor is below $T_s$, a maximum input load is provided to the heater such that supplemental heat energy is introduced into the void chamber at a rate sufficient to increase the temperature measured at the sensor. Transitions between providing the nominal input load to the heater and providing the maximum input load to the heater proceed rapidly and without regard to the effect on the temperature measured at the sensor.

The invention is further directed to a method for oxidizing a combustible component of an oxygen-containing feed gas mixture in a regenerative heat transfer oxidizer system. The system comprises a vessel containing at least two heat exchange zones in fluid communication through a void chamber and a heater for introducing supplemental heat energy into the void chamber. Each of the heat exchange zones contains a gas-permeable bed comprising solid heat exchange material. The system further comprises a sensor for measuring the temperature at a position within the vessel and a heater controller for varying the input load to the heater in response to the temperature measured at the sensor. The method comprises introducing the feed gas mixture into the vessel and passing it through the gas-permeable bed within one of the heat exchange zones such that it contacts the solid heat exchange material therein and heat stored in the heat exchange material is transferred to the feed gas mixture and thereby heats the feed gas mixture. The combustible component of the heated feed gas mixture is then oxidized to produce a reacted gas comprising the oxidized component of the feed gas mixture. Reacted gas is passed through the gas-permeable bed within another of the heat exchange zones and contacts the solid heat exchange material therein such that heat is transferred from the reacted gas to the heat exchange material and thereby cools the reacted gas. Cooled reacted gas is discharged from the vessel. The direction of gas flow through the heat exchange zones is reversed in a continuing series of cycles such that heat that has been transferred from the reacted gas to the solid heat exchange material is transferred to the feed gas mixture introduced into the vessel. The temperature at the sensor is measured and compared to a set temperature value, $T_s$. While the temperature measured at the sensor is above $T_s$, a nominal input load is provided to the heater such that supplemental heat energy is introduced into the void chamber at a rate below that required to prevent the temperature measured at the sensor from decreasing. While the temperature measured at the sensor is below $T_s$, a maximum input load is provided to the heater such that supplemental heat energy is introduced into the void chamber at a rate sufficient to increase the temperature measured at the sensor. Transitions between providing the nominal input load to the heater and providing the maximum input load to the heater proceed rapidly and without regard to the effect on the temperature measured at the sensor.

The invention is still further directed to a regenerative heat transfer oxidizer system for oxidizing a combustible component of an oxygen-containing feed gas mixture. The system comprises a vessel and a gas handling system. The vessel contains at least two heat exchange zones in fluid communication through a void chamber, each of the heat exchange zones containing a gas-permeable bed comprising solid heat exchange material. The gas handling system introduces the feed gas mixture into the vessel and discharges reacted gas comprising the oxidized component of the feed gas mixture from the vessel. The feed gas mixture introduced into the vessel passes through the gas-permeable bed within one of the heat exchange zones and contacts the solid heat exchange material therein such that heat stored in the heat exchange material is transferred to the feed gas mixture and thereby heats the feed gas mixture. Reacted gas passes through the gas-permeable bed within another of the heat exchange zones and contacts the solid heat exchange material therein such that heat is transferred from the reacted gas to the heat exchange material and thereby cools the reacted gas. The gas handling system is adapted such that the direction of gas flow through the heat exchange zones can be selectively reversed in a continuing series of cycles whereby heat that has been transferred from the reacted gas to the solid heat exchange material is transferred to feed gas mixture being introduced into the vessel. The system further comprises a heater for introducing supplemental heat energy into the void chamber and a sensor for measuring the temperature at a position within the vessel. A heater controller compares the temperature measured at the sensor to a predetermined set temperature value, $T_s$, and varies the input load to the heater. The heater controller is programmed such that: (1) the heater is provided with a nominal input load while the temperature measured at the sensor is above $T_s$ such that supplemental heat energy is introduced into the void chamber at a rate below that required to prevent the temperature measured at the sensor from decreasing; (2) the heater is provided with a maximum input load while the temperature measured at the sensor is below $T_s$ such that supplemental heat energy is introduced into the void chamber at a rate sufficient to increase the temperature measured at the sensor; and (3) transitions between providing the nominal input load to the heater and providing the maximum input load to the heater proceed rapidly and without regard to the effect on the temperature measured at the sensor.

Finally, the present invention is directed to operation of a regenerative heat transfer oxidizer system for oxidizing a combustible component of an oxygen-containing feed gas mixture, the concentration of the combustible component in the feed gas mixture being insufficient to sustain the oxidation. The system comprises a vessel containing at least two heat exchange zones in fluid communication through a void chamber and a heater for introducing supplemental heat energy into the void chamber in order to sustain the oxidation. Each of the heat exchange zones contains a gas-permeable bed of solid heat exchange material. The system further comprises a sensor for measuring the temperature at a position within the vessel and a heater controller for varying the input load to the heater in response to the temperature measured at the sensor. The supplemental heat energy introduced into the void chamber by the heater is nonuniformly distributed within the void chamber and the gas-permeable beds when the input load to the heater is varied by the heater controller in a manner which maintains the temperature measured at the sensor essentially constant, thereby causing radial temperature gradients to prevail within the void chamber and the gas-permeable beds. In accordance with the present invention, an improved manner for controlling operation of the heater so as to reduce radial temperature gradients within the void chamber and the gas-permeable beds is provided. The improvement comprises measuring the temperature at the sensor and operating the heater at a nominal input load such that supplemental heat energy is introduced into the void chamber at a rate below that required to prevent the temperature measured at the sensor from decreasing. The nominal input load is low enough so as to avoid substantial radial temperature gradients within the void chamber and the gas-permeable beds irrespective of the extent of radial mixing of gas within the system. The measured temperature is compared to a set temperature value, $T_s$. When the temperature measured at the sensor falls below $T_s$, the input load to the heater is rapidly increased from the nominal input load to a maximum input load such that supplemental heat energy is introduced into the void chamber at a rate sufficient to increase the temperature measured at the sensor. The extent of radial mixing of gas within the system while the heater is operated at the maximum input load is sufficient to avoid creating substantial radial temperature gradients within the void chamber and the gas-permeable beds. Once the temperature measured at the sensor rises above $T_s$, the input load to the heater is rapidly decreased from the maximum input load to the nominal input load.

Other objects and features of this invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

It has been determined that conventional control of heaters used to introduce supplemental heat energy into regenerative heat transfer oxidizer systems, particularly in the case of a burner, is a significant factor contributing to nonuniform temperature distributions in those regions of the system critical to oxidation efficiency. As noted above, conventional control typically results in a moderate input load being delivered to the heater on a more or less continuous basis. In oxidizer systems employing a burner, it is believed that during the relatively constant operation at moderate fuel load, the flow of gas through the oxidizer does not mix to a substantial degree with the combustion gases emitted from the burner. This channeling of the combustion gases and the process gas flow through the oxidizer is present during much of the process and leads to uneven heating and ultimately significant temperature differences within the volume of flow space separating the beds of heat exchange material that serves as the combustion chamber in RTOs and across transverse cross sections of the packed beds of heat exchange and/or catalyst material. Moderate power input to an electric heating element throughout much of the process produces similar temperature nonuniformities in these critical regions of the system. Oxidation of combustible components of the feed gas is reduced in those portions of the combustion chamber and catalytic zones that are insufficiently heated, compromising the overall efficiency of the oxidizer. Even if the load to the supplemental heat source is increased generally in an attempt to raise the temperature in those locations within the system prone to insufficient heating or if the temperature used to control the input load to the heat source is measured in such a location and the temperature therein is maintained sufficiently high, the nonuniformities in the temperature profile nevertheless represent increased operating costs, potential overheating and decreased service life for the system.

In accordance with the present invention, the temperature nonuniformities accompanying conventional modulated control of a heater associated with a heat regenerative oxidizer system are remedied by using a different mode of heater control described in detail below.

Figure 1:
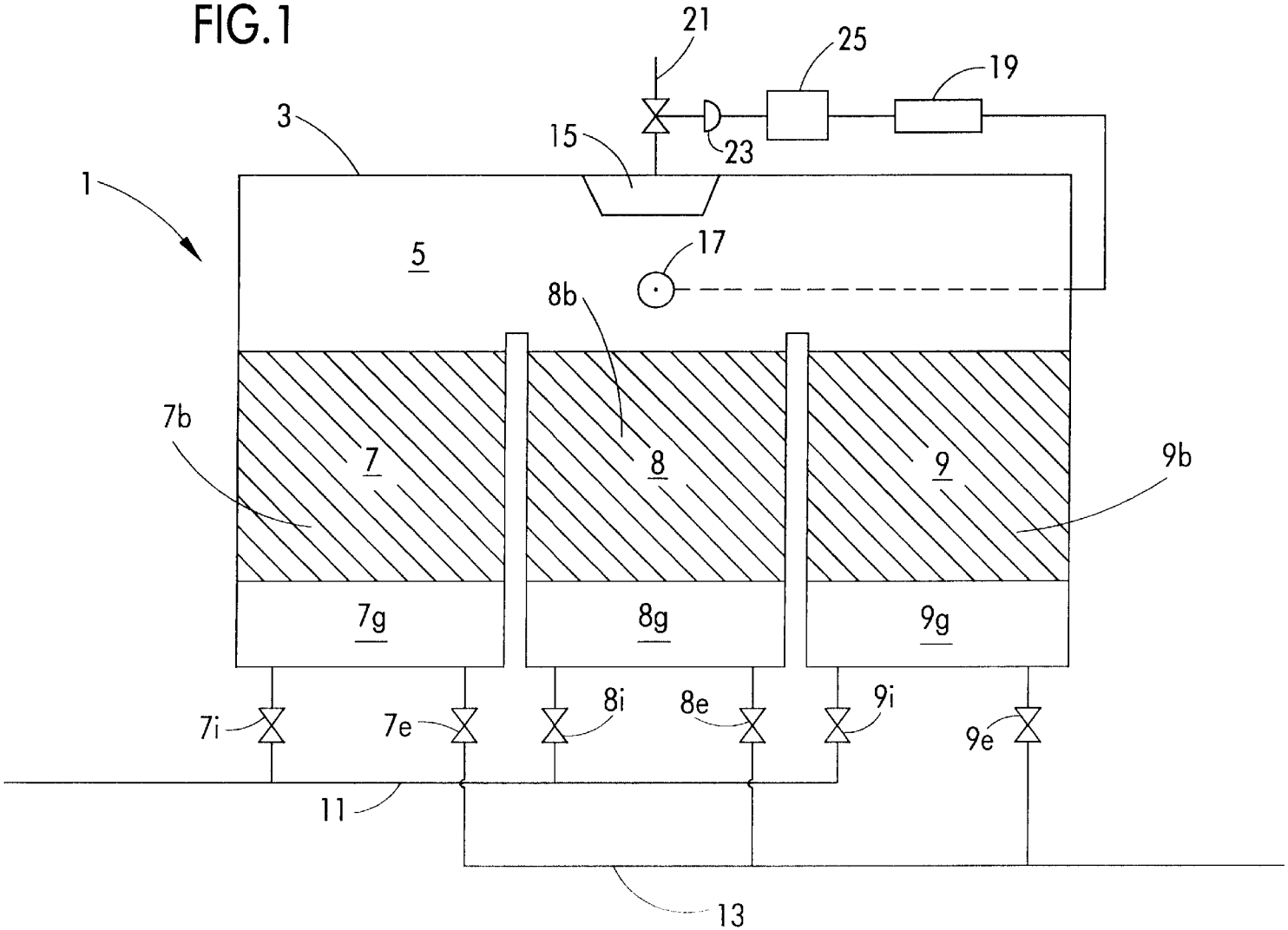
FIG. 1 schematically shows a regenerative thermal oxidizer system in accordance with the present invention.

With reference to FIG. 1, a general description of a regenerative heat transfer oxidizer system and its operation are in order. An oxidizer system in accordance with the present invention is shown schematically and generally designated by reference numeral 1. It will be understood by those skilled in the art that the present invention may be used in conjunction with regenerative heat transfer oxidizer systems of various configurations and modes of operation, the following description intended to be merely illustrative of the type of system in which the present invention may be applied.

The incinerator 1 comprises a vessel 3 containing at least two heat exchange zones in fluid communication through a central void chamber 5. In the embodiment shown in FIG. 1, the oxidizer system includes three heat exchange zones 7, 8 and 9. Each of the heat exchange zones contains a gas-permeable bed 7*b*, 8*b* and 9*b* disposed above respective gas distribution/collection zones 7*g*, 8*g* and 9*g*. The gas-permeable beds comprise solid bodies selected from inert heat exchange material and catalyst for promoting the oxidation of combustible components in the feed gas mixture. In RTOs, the gas-permeable beds are comprised solely of inert heat exchange solids, while in RCOs, the gas-permeable beds further include an oxidation catalyst. The system depicted in FIG. 1 is an RTO in which each of the gas-permeable beds contain only inert heat exchange solids.

The heat exchange solids and any catalyst employed should be capable of withstanding process temperatures and pressures and may be in the form of particulate packings or monoliths (e.g., a honeycomb). If particulate solids are used, the particles may have any desired shape such as spheres, saddles, cylinders or Rachig rings and preferably have a nominal diameter of from about 2 mm to about 6 cm. Suitable heat exchange materials include ceramics such as $SiO_2$ and $Al_2O_3$, stoneware and mineral matter. The heat exchange material desirably has an average heat capacity in excess of about 0.15 cal/cm$^3$, more preferably in excess of about 0.2 cal/cm$^3$. Suitable oxidation catalysts include noble metal catalysts such as platinum and palladium as well as metal oxide catalysts. The selection of the type and quantity of heat exchange material and catalyst employed in heat regenerative oxidizer systems to achieve the desired results is well-known to those skilled in the art and is not changed in the practice of the present invention.

The oxidizer system 1 further includes a gas handling system for introducing the feed gas mixture into the vessel and discharging reacted gas comprising the oxidized component of the feed gas mixture from the vessel. As described in greater detail below, the gas handling system is adapted such that the direction of gas flow through the heat exchange zones can be selectively reversed in a continuing series of cycles whereby heat that has been transferred from the reacted gas to the solid heat exchange material is transferred to feed gas mixture being introduced into the vessel. As shown in FIG. 1, the gas handling system comprises an intake manifold 11 and an exhaust manifold 13. The feed gas mixture enters the oxidizer system through intake manifold 11 and reacted gas containing oxidized components of the feed gas mixture is discharged from the vessel to a recipient such as a storage vessel or a stack (not shown) through exhaust manifold 13. A blower or fan (not shown) is used to provide the motive force for movement of gas through the oxidizer system and may be installed upstream of the vessel in the intake manifold in a "push" configuration or downstream of the vessel in the exhaust manifold in a "pull" configuration.

Heat exchange zones 7, 8 and 9 are in selective fluid communication with intake manifold 11 and exhaust manifold 13. Associated with heat exchange zones 7, 8 and 9 are intake valves 7*i*, 8*i*, and 9*i* and exhaust valves 7*e*, 8*e* and 9*e*, respectively. While a heat exchange zone is operating in the intake mode, the associated intake valve allows incoming feed gas mixture to flow from the intake manifold and enter the gas distribution/collection zone beneath the gas-permeable bed. While a heat exchange zone is operating in the exhaust mode, the associated exhaust valve allows reacted gas to flow from the gas distribution/collection zone beneath the gas-permeable bed and be discharged from the vessel through the exhaust manifold.

Operation of the oxidizer system depicted in FIG. 1 employing a six-phase (phases A through F) heat cycle is now briefly described for purposes of illustration.

In phase A, valves 7*i* and 8*e* are opened and valves 7*e*, 8*i*, 9*i* and 9*e* are closed so that heat exchange zone 7 is operated in the intake mode, heat exchange zone 8 is operated in the exhaust mode and heat exchange zone 9 is static. Feed gas mixture containing oxygen and a combustible component is introduced from inlet manifold 11 into vessel 3 and flows through gas distribution/collection zone 7*g* before entering gas-permeable bed 7*b*. The gas distribution/collection zones promote uniform flow of feed gas mixture through the heat exchange zones. As the feed gas passes upwardly through bed 7*b*, it contacts solid heat exchange material therein and is heated by transfer of heat stored during a previous phase of the heat cycle. The feed gas mixture is heated to a temperature sufficient to substantially oxidize the combustible component thereof as it passes through bed 7*b* and subsequently through void chamber 5 and bed 8*b*. Reacted gas comprising the oxidized component of the feed gas mixture passes downwardly through bed 8*b* and cools as it contacts and transfers heat to the solid heat exchange material therein. The cooled reacted gas then passes through gas distribution/collection zone 8*g* before being discharged from the vessel through exhaust manifold 13. At some point, gas flow through the oxidizer system 1 is redirected by closing valve 8*e* and opening valve 9*e* to initiate phase B of the cycle. The timing for transition from phase A to phase B of the cycle may be determined in various ways known in the art. For example, the transition may be initiated once bed 7*b* is cooled to a preselected temperature, bed 8*b* is heated to a preselected temperature, or a prescribed period of time has elapsed. Typically, the duration of phase A is from about 2 minutes to about 10 minutes, although longer or shorter periods may be employed.

In phase B, heat exchange zone 7 is operated in the intake mode, heat exchange zone 8 is static and heat exchange zone 9 is operated in the exhaust mode. Phase B is an intermediate step in the change-over of heat exchange zone 8 from the exhaust mode to the intake mode which allows gas to flow continuously through the oxidizer system during the change-over without discharge of unreacted feed gas mixture from the system which may occur if valves 8*i* and 8*e* are repositioned simultaneously. Thus, the duration of phase B, typically 5 to 10 seconds, need only be long enough to reposition valve 8*e* to its closed position.

Operation of the oxidizer continues through phases C–F of the heat cycle in accordance with the valve schedule set forth below in Table 1 such that each of the heat exchange zones is operated in the intake, static and exhaust modes in consecutive phases of the heat cycle. In this manner, the direction of gas flow through the heat exchange zones is reversed in a continuing series of cycles such that heat transferred from the reacted gas to the heat exchange material within a heat exchange zone operated in the exhaust mode is transferred to the feed gas mixture introduced into the vessel when that heat exchange zone is subsequently operated in the intake mode. Phases B, D, and F of the operating cycle, although preferred, may be eliminated.

TABLE 1

| PHASE | HEAT EXCHANGE ZONE | MODE | VALVE NO. 7i | 7e | 8i | 8e | 9i | 9e | TIME |
|---|---|---|---|---|---|---|---|---|---|
| A | 7 | Intake | O | C | | | | | 2–10 min. |
| | 8 | Exhaust | | | C | O | | | |
| | 9 | Static | | | | | C | C | |
| B | 7 | Intake | O | C | | | | | 5–20 sec. |
| | 8 | Static | | | C | C | | | |
| | 9 | Exhaust | | | | | C | O | |
| C | 7 | Static | C | C | | | | | 2–10 min. |
| | 8 | Intake | | | O | C | | | |
| | 9 | Exhaust | | | | | C | O | |
| D | 7 | Exhaust | C | O | | | | | 5–20 sec. |
| | 8 | Intake | | | O | C | | | |
| | 9 | Static | | | | | C | C | |
| E | 7 | Exhaust | C | O | | | | | 2–10 min. |
| | 8 | Static | | | C | C | | | |
| | 9 | Intake | | | | | O | C | |
| F | 7 | Static | C | C | | | | | 5–20 sec. |
| | 8 | Exhaust | | | C | O | | | |
| | 9 | Intake | | | | | O | C | |

O: Open
C: Closed

It should be understood that the preceding on is for general illustration purposes only and is not intended to limit application of the present invention to regenerative heat transfer oxidizer systems configured and operated as described above. The oxidizer system may differ in a various ways without departing from the scope of the present invention. For example, instead of three heat exchange zones, the oxidizer system 1 may include only two or four or more such zones in fluid communication with the void chamber. In the case of an oxidizer system including three or more heat exchange zones, multiple heat exchange zones may be simultaneously operated in the intake or exhaust mode. By simultaneously operating multiple heat exchange zones in the intake or exhaust mode, the pressure drop across the incinerator may be reduced, thereby decreasing energy requirements. In the case of a system including only two heat exchange zones, rather than side-by-side, the heat exchange zones may be positioned one on top of the other separated by the void chamber. Furthermore, various alternative flow schemes may be employed. For example, the heat exchange zones may be purged after being operated in the intake mode to prevent unreacted feed gas mixture trapped in the heat exchange zones from being discharged when the heat exchange zone is subsequently operated in the exhaust mode. Operation of a regenerative heat transfer oxidizer having three or more heat exchange zones and including such a purging step is described in U.S. Pat. No. 5,364,259 (Matros, et al.), the entire disclosure of which is expressly incorporated herein by reference. Alternatively, in an oxidizer system including only two heat exchange zones, purging may be achieved without interrupting the flow of feed gas mixture introduced into the system by utilizing the bypass flow schemes described in U.S. Pat. No. 5,823,770 (Matros, et al.) and U.S. Pat. No. 5,366,708 (Matros, et al.), the entire disclosures of which are also expressly incorporated herein by reference. Furthermore, although the oxidizer system 1 shown in FIG. 1 is depicted as an RTO, the heat exchange zones may contain an oxidation catalyst such that the system functions as an RCO.

Figure 2:
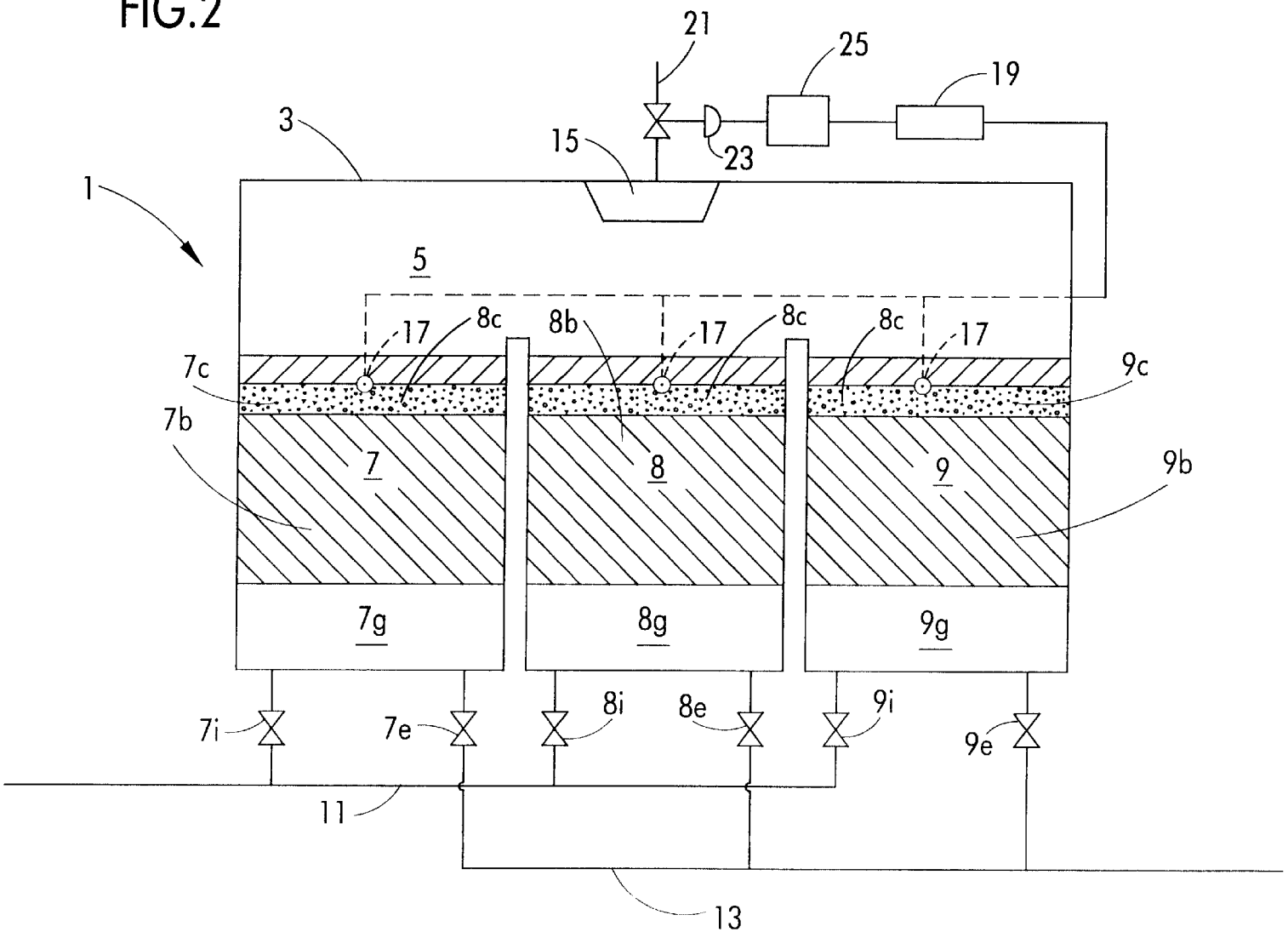
FIG. 2 schematically shows a regenerative catalytic oxidizer system in accordance with the present invention.

FIG. 2 schematically shows a regenerative catalytic oxidizer system in accordance with the present invention. The preceding description with respect to the construction and operation of the RTO system shown in FIG. 1 applies generally to the RCO system of FIG. 2 except that in the latter, the heat exchange zones 7, 8 and 9 include a layer of catalyst 7*c*, 8*c* and 9*c*. Preferably, the catalyst layers are interposed between a large mass of solid heat exchange material below 7*b*, 8*b* and 9*b* and a much shallower layer of heat exchange material on top adjacent the void chamber 5. The shallow layer of heat exchange material helps to inhibit rapid temperature changes in the catalytic zones defined by the catalyst layers and protects the catalyst from thermal degradation. The feed gas mixture introduced into the RCO system is heated as it passes upwardly through the heat exchange zone(s) operated in the intake mode and contacts solid heat exchange material therein. The combustible component of the heated feed gas mixture is substantially oxidized in the catalyst layer of the heat exchange zone(s) operated in the intake mode. Reacted gas comprising the oxidized component of the feed gas mixture then flows into void chamber 5. Due to the relatively lower operating temperatures typically prevailing in the void chamber of an RCO, only a negligible amount of any combustible components remaining in the gas are oxidized in the void chamber. The reacted gas then enters the heat exchange zone(s) operated in the exhaust mode wherein any remaining combustible components of the feed gas are oxidized in the catalyst layer contained therein. As the reacted gas continues to pass downwardly through the heat exchange zone, it cools as it contacts and transfers heat to the solid heat exchange material.

The oxidizer system 1 further includes a heater such as an electric heating element disposed within the void chamber 5 or, as shown in FIGS. 1 and 2, an externally fueled burner 15, such as a natural gas burner, directed into void chamber 5. The heater is operated to introduce supplemental heat energy into void chamber 5 when the concentration of the combustible component in the feed gas mixture is insufficient to sustain the oxidation at the desired level. The system further comprises a sensor 17, such as a thermocouple, for measuring the temperature at a position within the vessel and a heater controller 19 for varying the input load to the heater in response to the temperature measured at the sensor. In applications where the heater is a burner, the input load is the fuel load delivered to the burner. As shown in FIG. 1, burner 15 is supplied with fuel through a fuel supply line 21 having a valve 23. Heater controller 19 varies the fuel load to burner 15 by sending a control signal to a valve regulator 25 which repositions valve 23 in response to the control signal. In applications where the heater is an electric heating element, the input load is the electric energy supplied to the element and heater controller 19 varies the load to the element by sending a control signal to a regulator such as an on-off switch or rheostat.

Sensor 17 may be positioned at various locations within the oxidizer system. Preferably, in the case of an RTO, sensor 17 is positioned within void chamber 5 as shown in FIG. 1 such that the temperature measured at the sensor corresponds to the temperature of the gas within the void chamber. In an RCO, sensor 17 is preferably positioned within at least one of the catalytic zones, for example, at the interface between the catalyst and the heat exchange material. However, when modifying an existing RCO installation in accordance with the present invention, it may be impractical to install a sensor within or adjacent the catalytic zones. In such instances, the sensor may be suitably positioned within the void chamber 5. In order to obtain a more accurate assessment of the control temperature, multiple sensors may be employed. For example, in the case of an RCO, one or more sensors may be placed within the catalytic zone in each of heat exchange zones 7, 8 and 9 at the interface between the catalyst layer and the shallow layer of heat exchange material as shown in FIG. 2 or at the interface between the catalyst layer and the large mass of solid heat exchange material 7*b*, 8*b* and 9*b*. Likewise in an RTO, multiple sensors may be positioned within the void chamber 5 or within gas-permeable beds 7*b*, 8*b* and 9*b* in contact with heat exchange material. When multiple sensors are employed, the control temperature may be determined at any one of the sensors or by averaging measurements from multiple sensors.

When conventional modulated heater control as previously described is used in connection with a system such as that shown in FIGS. 1 and 2, supplemental heat energy introduced into the void chamber by the heater is nonuniformly distributed within the void chamber and the gas-permeable beds within the heat exchange zones. This in turn causes radial temperature gradients to prevail within the void chamber and the gas-permeable beds. An improved mode of heater control in accordance with the present invention which reduces radial temperature gradients within the void chamber and the gas-permeable beds is now described.

As with conventional heater control, the control variable used in the practice of the present invention is the temperature measured at one or more locations within the oxidizer system by one or more sensors 17. However, no attempt is made to avoid significant differences between the measured control temperatures and the predetermined set temperature value, $T_s$, by continuous modulation of the input load to the heater. Instead, the input load supplied to the heater is either one of two extremes, a nominal input load or a maximum input load, with the only exception being the time period necessary to switch the input load from one extreme to the other. Preferably, in order to simplify implementation of the present invention, the nominal input load and the maximum input load are fixed values.

This "two-position" control results in the heater receiving the nominal input load for most of the process, thereby substantially avoiding the uneven heating resulting from prolonged operation of the heater at moderate input load. Moreover, while the heater is operated at the maximum input load for short periods of time, the resulting increased gas velocity and turbulence provides enhanced mixing of gases and more uniform heating throughout the system. The enhanced gas mixing attendant high amplitude operation of the heater at maximum input load is especially present in the case of a burner due to the tremendous turbulence induced by injecting combustion gases into the system at a high rate. By reducing temperature nonuniformities and "cold spots" within the oxidizer, the present invention provides a system capable of increased contaminant destruction efficiency when used to treat industrial gaseous effluents.

Sensor 17 measures the temperature at a location within the vessel and a signal corresponding to the temperature measured at the sensor is sent to heater controller 19 which compares the measured control temperature to a set temperature value, $T_s$. While the temperature measured at sensor 17 is above $T_s$, heater controller 19 provides the nominal input load to burner 15. Conversely, while the temperature measured at sensor 17 is below $T_s$, heater controller 19 provides the maximum input load to the burner 15. Transitions between providing the nominal input load and the maximum input load to the heater proceed as rapidly as possible and without regard to the effect on the temperature measured at sensor 17. In the case of burner 15, the switching period is determined by the speed of the valve regulator 25 which repositions the valve that meters the fuel load to the burner. In the case of an electric heater, transitions between the maximum input load and the nominal input load may be essentially instantaneous.

The nominal input load to the heater is selected such that supplemental heat energy is introduced into void chamber 5 at a rate below that required to prevent the temperature measured at sensor 17 from decreasing and is preferably low enough so as to avoid substantial radial temperature gradients within void chamber 5 and the gas-permeable beds within heat exchange zones 7, 8 and 9 irrespective of the extent of radial mixing of gas within the system. Preferably, the nominal input load is zero such that the supply of supplemental heat energy to the void chamber is essentially terminated. That is, in the case of burner 15, valve 23 is turned to the full off position. However, this preference may prove to be impractical alternative when modifying an existing oxidizer system in accordance with the present invention, especially in the case of systems which employ a burner not equipped with a pilot system for reigniting the burner. In such instances, the nominal input load should be established as close as possible to the minimum burner turndown. That is, the minimum fuel supply necessary to maintain a stable flame.

The maximum input load to the heater is selected such that supplemental heat energy is introduced into the void chamber at a rate sufficient to increase the temperature measured at sensor 17. Preferably, the extent of radial mixing of gas within the system while the heater is operated at the maximum input load is sufficient to avoid creating substantial radial temperature gradients within void chamber 5 and the gas-permeable beds within heat exchange zones 7, 8 and 9. In accordance with an especially preferred embodiment, the maximum input load is established as close as possible to the design capacity of the heater within the limits set by of appropriate safety considerations in order to maximize the benefits of increased turbulence and enhanced mixing of gases within the system. Preferably, in the case of a burner where the nominal input load is set at the minimum burner turndown, the ratio of the maximum fuel load to the nominal fuel load is at least about 5, more preferably at least about 10 or higher.

Heater control in accordance with the present invention typically results in the heater being operated at a nominal input load for periods of from about 5 to about 10 minutes separated by intervals of from about 10 to about 30 seconds during which the heater is operated at maximum input load.

In an alternative embodiment of the present invention, heater controller 19 employs a dead band around the predetermined set temperature value, $T_s$, such that $T_s$ is an interval from $T_{low}$ to $T_{high}$, $T_{low}<T_{high}$. In such an embodiment, the nominal input load is provided to the heater when the temperature measured at the sensor is greater than $T_{high}$ until the temperature measured at the sensor is less than $T_{low}$. Conversely, the maximum input load is provided to the heater when the temperature measured at the sensor is less than $T_{low}$ until the temperature measured at the sensor is greater than $T_{high}$. In such embodiments, the interval from $T_{low}$ to $T_{high}$ is typically less than about 20° C. Use of a dead band may be necessary when recalibrating a conventional proportional-integral-derivative controller of an existing oxidizer system so as to function in accordance with the present invention. It should be appreciated that the present invention is applicable to new oxidizer installations as well as to retrofitting existing systems employing conventional heater control. As will be understood by those skilled in the art, conventional proportional-integral-derivative controllers may be made to function in accordance with the present invention by generally maximizing the proportional band while generally minimizing the integral and derivative bands.

Whether or not a dead band is employed in the practice of the present invention, the predetermined set temperature, Ts, should be selected such that the temperature measured at the sensor is maintained above the minimum temperature required for sustained oxidation of the combustible component of the feed gas mixture at the desired level. Preferably, the lowest temperature measured at the sensor is not more than about 100° C. above the minimum temperature required for sustained oxidation of the combustible component of the feed gas mixture at the desired level. In the case of an RTO, wherein sensor 17 is positioned within void chamber 5, $T_s$ is typically set from about 600° C. to about 1000° C. In an RCO, wherein sensor 17 is positioned within the catalytic zones, $T_s$ is typically set from about 200° C. to about 700° C.

As noted above, heater control in accordance with the present invention advantageously provides a more uniform temperature gradient across transverse cross sections of the gas-permeable beds within heat exchange zones 7, 8 and 9. Preferably, operation of the heater is controlled such that the difference between the highest and lowest temperature in a transverse cross section of each of the gas-permeable beds is less than about 20° C., more preferably, less than about 10° C. and especially less than about 5° C.

In view of the above, it will be seen that the several objects of the invention are achieved. As various changes could be made in the above methods and apparatus without departing from the scope of the invention, it is intended that all matter contained in the above description be interpreted as illustrative and not in a limiting sense.

What is claimed is:

1. A method for controlling operation of a heater associated with a regenerative heat transfer oxidizer system used to oxidize a combustible component of an oxygen-containing feed gas mixture, the system comprising a vessel containing at least two heat exchange zones in fluid communication through a void chamber and the heater for introducing supplemental heat energy into the void chamber, each of the heat exchange zones containing a gas-permeable bed comprising solid heat exchange material, the system further comprising a sensor for measuring the temperature at a position within the vessel and a heater controller for varying the input load to the heater in response to the temperature measured at the sensor, the method comprising:

measuring the temperature at the sensor;

comparing the measured temperature to a set temperature value, $T_s$;

providing a nominal input load to the heater while the temperature measured at the sensor is above $T_s$ such that supplemental heat energy is introduced into the void chamber at a rate below that required to prevent the temperature measured at the sensor from decreasing; and providing a maximum input load to the heater while the temperature measured at the sensor is below $T_s$ such that supplemental heat energy is introduced into the void chamber at a rate sufficient to increase the temperature measured at the sensor, transitions between providing the nominal input load to the heater and providing the maximum input load to the heater proceeding rapidly and without regard to the effect on the temperature measured at the sensor.

2. A method as set forth in claim 1 wherein the nominal input load and the maximum input load to the heater are fixed values.

3. A method as set forth in claim 2 wherein the nominal input load is low enough so as to avoid substantial radial temperature gradients within the void chamber and the gas-permeable beds irrespective of the extent of radial mixing of gas within the system and the extent of radial mixing of gas within the system while the heater is operated at the maximum input load is sufficient to avoid creating substantial radial temperature gradients within the void chamber and the gas-permeable beds.

4. A method as set forth in claim 2 wherein the nominal input load to the heater is zero.

5. A method as set forth in claim 2 wherein the heater is a burner directed into the void chamber and the input load to the heater is the fuel load delivered to the burner, the burner being supplied with fuel through a fuel supply line having a valve for varying the rate at which fuel is delivered to the burner, the heater controller varying the fuel load to the burner from the fixed nominal fuel load to the fixed maximum fuel load and from the fixed maximum fuel load to the fixed nominal fuel load by sending a control signal to a valve regulator which repositions the valve in the fuel supply line.

6. A method as set forth in claim 5 wherein the fixed nominal fuel load to the burner is the minimum burner turndown.

7. A method as set fourth in claim 6 wherein the ratio of the fixed maximum fuel load to the fixed nominal fuel load is at least about 5.

8. A method as set forth in claim 5 wherein the oxidizer system is a regenerative thermal oxidizer and the sensor is positioned within the void chamber such that the temperature measured at the sensor corresponds to the temperature of the gas within the void chamber.

9. A method as set forth in claim 8 wherein $T_s$ is from about 600° C. to about 1000° C.

10. A method as set forth in claim 5 wherein the system is a regenerative catalytic oxidizer comprising at least one catalytic zone and the sensor is positioned within the catalytic zone.

11. A method as set forth in claim 10 wherein $T_s$ is from about 200° C. to about 700° C.

12. A method as set forth in claim 2 wherein $T_s$ is an interval from $T_{low}$, to $T_{high}$, $T_{low}<T_{high}$, the method comprising providing the fixed nominal input load to the heater when the temperature measured at the sensor is greater than $T_{high}$ and continuing to provide the fixed nominal input load to the heater until the temperature measured at the sensor is less than $T_{low}$ and providing the fixed maximum input load to the heater when the temperature measured at the sensor is less than $T_{low}$ and continuing to provide the maximum input load to the heater until the temperature measured at the sensor is greater than $T_{high}$.

13. A method as set forth in claim 12 wherein the interval from $T_{low}$ to $T_{high}$ is less than about 20° C.

14. A method for oxidizing a combustible component of an oxygen-containing feed gas mixture in a regenerative heat transfer oxidizer system, the system comprising a vessel containing at least two heat exchange zones in fluid communication through a void chamber and a heater for introducing supplemental heat energy into the void chamber, each of the heat exchange zones containing a gas-permeable bed comprising solid heat exchange material, the system further comprising a sensor for measuring the temperature at a position within the vessel and a heater controller for varying the input load to the heater in response to the temperature measured at the sensor, the method comprising:

introducing the feed gas mixture into the vessel;

passing the feed gas mixture introduced into the vessel through the gas-permeable bed within one of the heat exchange zones and contacting the solid heat exchange material therein such that heat stored in the heat exchange material is transferred to the feed gas mixture and thereby heats the feed gas mixture;

oxidizing the combustible component of the heated feed gas mixture to produce a reacted gas comprising the oxidized component of the feed gas mixture;

passing the reacted gas through the gas-permeable bed within another of the heat exchange zones and contacting the reacted gas with the solid heat exchange material therein such that heat is transferred from the reacted gas to the heat exchange material and thereby cools the reacted gas;

discharging the cooled reacted gas from the vessel;

reversing the direction of gas flow through the heat exchange zones in a continuing series of cycles such that heat that has been transferred from the reacted gas to the solid heat exchange material is transferred to the feed gas mixture introduced into the vessel;

measuring the temperature at the sensor;

comparing the measured temperature to a set temperature value, $T_s$;

providing a nominal input load to the heater while the temperature measured at the sensor is above $T_s$ such that supplemental heat energy is introduced into the void chamber at a rate below that required to prevent the temperature measured at the sensor from decreasing; and providing a maximum input load to the heater while the temperature measured at the sensor is below $T_s$ such that supplemental heat energy is introduced into the void chamber at a rate sufficient to increase the temperature measured at the sensor, transitions between providing the nominal input load to the heater and providing the maximum input load to the heater proceeding rapidly and without regard to the effect on the temperature measured at the sensor.

15. A method as set forth in claim 14 wherein the nominal input load and the maximum input load to the heater are fixed values.

16. A method as set forth in claim 15 wherein the nominal input load to the heater is zero.

17. A method as set forth in claim 15 wherein $T_s$ is an interval from $T_{low}$, to $T_{high}$, $T_{low}<T_{high}$, the method comprising providing the fixed nominal input load to the heater when the temperature measured at the sensor is greater than $T_{high}$ and continuing to provide the fixed nominal input load to the heater until the temperature measured at the sensor is less than $T_{low}$ and providing the fixed maximum input load to the heater when the temperature measured at the sensor is less than $T_{low}$ and continuing to provide the maximum input load to the heater until the temperature measured at the sensor is greater than $T_{high}$.

18. A method as set forth in claim 15 wherein the heater is a burner directed into the void chamber and the input load to the heater is the fuel load delivered to the burner, the burner being supplied with fuel through a fuel supply line having a valve for varying the rate at which fuel is delivered to the burner, the heater controller varying the fuel load to the burner from the fixed nominal fuel load to the fixed maximum fuel load and from the fixed maximum fuel load to the fixed nominal fuel load by sending a control signal to a valve regulator which repositions the valve in the fuel supply line.

19. A method as set forth in claim 18 wherein the period for transition between providing the nominal input load to the heater and providing the maximum input load to the heater is determined by the speed of the valve regulator.

20. A regenerative heat transfer oxidizer system for oxidizing a combustible component of an oxygen-containing feed gas mixture, the system comprising:

a vessel containing at least two heat exchange zones in fluid communication through a void chamber, each of the heat exchange zones containing a gas-permeable bed comprising solid heat exchange material;

a gas handling system for introducing the feed gas mixture into the vessel and for discharging reacted gas comprising the oxidized component of the feed gas mixture from the vessel, the feed gas mixture introduced into the vessel passing through the gas-permeable bed within one of the heat exchange zones and contacting the solid heat exchange material therein such that heat stored in the heat exchange material is transferred to the feed gas mixture and thereby heats the feed gas mixture, reacted gas passing through the gas-permeable bed within another of the heat exchange zones and contacting the solid heat exchange material therein such that heat is transferred from the reacted gas to the heat exchange material and thereby cools the reacted gas, the gas handling system being adapted such that the direction of gas flow through the heat exchange zones can be selectively reversed in a continuing series of cycles whereby heat that has been transferred from the reacted gas to the solid heat exchange material is transferred to feed gas mixture being introduced into the vessel;

a heater for introducing supplemental heat energy into the void chamber;

a sensor for measuring the temperature at a position within the vessel; and a heater controller for comparing the temperature measured at the sensor to a predetermined set temperature value, $T_s$, and varying the input load to the heater, the heater controller being programmed such that:

the heater is provided with a nominal input load while the temperature measured at the sensor is above $T_s$ such that supplemental heat energy is introduced into the void chamber at a rate below that required to prevent the temperature measured at the sensor from decreasing;

the heater is provided with a maximum input load while the temperature measured at the sensor is below $T_s$ such that supplemental heat energy is introduced into the void chamber at a rate sufficient to increase the temperature measured at the sensor; and transitions between providing the nominal input load to the heater and providing the maximum input load to the heater proceed rapidly and without regard to the effect on the temperature measured at the sensor.

21. A regenerative heat transfer oxidizer system as set forth in claim 20 wherein the nominal input load and the maximum input load to the heater are fixed values.

22. A regenerative heat transfer oxidizer system as set forth in claim 21 wherein the nominal input load to the heater is zero.

23. A regenerative heat transfer oxidizer system as set forth in claim 21 wherein $T_s$ is an interval from $T_{low}$ to $T_{high}$, $T_{low}<T_{high}$ and the heater controller is programmed such that the heater is provided with the fixed nominal input load when the temperature measured at the sensor is greater than $T_{high}$ and continuing until the temperature measured at the sensor is less than $T_{low}$ and the heater is provided with the fixed maximum input load when the temperature measured at the sensor is less than $T_{low}$ and continuing until the temperature measured at the sensor is greater than $T_{high}$.

24. A regenerative heat transfer oxidizer system as set forth in claim 21 wherein the heater is a burner directed into the void chamber and the input load to the heater is the fuel load delivered to the burner, the burner being supplied with fuel through a fuel supply line having a valve for varying the rate at which fuel is delivered to the burner, the heater controller varying the fuel load to the burner from the fixed nominal fuel load to the fixed maximum fuel load and from the fixed maximum fuel load to the fixed nominal fuel load by sending a control signal to a valve regulator which repositions the valve in the fuel supply line.

25. In operation of a regenerative heat transfer oxidizer system for oxidizing a combustible component of an oxygen-containing feed gas mixture, the concentration of the combustible component in the feed gas mixture being insufficient to sustain the oxidation, the system comprising a vessel containing at least two heat exchange zones in fluid communication through a void chamber and a heater for introducing supplemental heat energy into the void chamber in order to sustain the oxidation, each of the heat exchange zones containing a gas-permeable bed of solid heat exchange material, the system further comprising a sensor for measuring the temperature at a position within the vessel and a heater controller for varying the input load to the heater in response to the temperature measured at the sensor, the supplemental heat energy introduced into the void chamber by the heater being nonuniformly distributed within the void chamber and the gas-permeable beds when the input load to the heater is varied by the heater controller in a manner which maintains the temperature measured at the sensor essentially constant, thereby causing radial temperature gradients to prevail within the void chamber and the gas-permeable beds, an improvement in the manner in which operation of the heater is controlled so as to reduce radial temperature gradients within the void chamber and the gas-permeable beds, the improvement comprising:

measuring the temperature at the sensor;

operating the heater at a nominal input load such that supplemental heat energy is introduced into the void chamber at a rate below that required to prevent the temperature measured at the sensor from decreasing, the nominal input load being low enough so as to avoid substantial radial temperature gradients within the void chamber and the gas-permeable beds irrespective of the extent of radial mixing of gas within the system;

comparing the measured temperature to a set temperature value, $T_s$;

rapidly increasing the input load to the heater from the nominal input load to a maximum input load when the temperature measured at the sensor falls below $T_s$ such that supplemental heat energy is introduced into the void chamber at a rate sufficient to increase the temperature measured at the sensor, the extent of radial mixing of gas within the system while the heater is operated at the maximum input load being sufficient to avoid creating substantial radial temperature gradients within the void chamber and the gas-permeable beds; and rapidly decreasing the input load to the heater from the maximum input load to the nominal input load when the temperature measured at the sensor rises above $T_s$.

26. An improvement as set forth in claim 25 wherein the difference between the highest and lowest temperature in a transverse cross section of each of the gas-permeable beds is less than about 20° C.

27. An improvement as set forth in claim 25 wherein the temperature measured at the sensor is maintained above the minimum temperature required for sustained oxidation of the combustible component of the feed gas mixture.

28. An improvement as set forth in claim 27 wherein the lowest temperature measured at the sensor is not more than about 100° C. above the minimum temperature required for sustained oxidation of the combustible component of the feed gas mixture.

* * * * *